US010718168B2

(12) United States Patent
Donald et al.

(10) Patent No.: US 10,718,168 B2
(45) Date of Patent: Jul. 21, 2020

(54) DRILLING OSCILLATION SYSTEMS AND OPTIMIZED SHOCK TOOLS FOR SAME

(71) Applicant: National Oilwell Varco, L.P., Houston, TX (US)

(72) Inventors: Sean Matthew Donald, Spring, TX (US); Andrew Lawrence Scott, Houston, TX (US); Yong Yang, Spring, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 330 days.

(21) Appl. No.: 15/847,840

(22) Filed: Dec. 19, 2017

(65) Prior Publication Data

US 2018/0171726 A1 Jun. 21, 2018

Related U.S. Application Data

(60) Provisional application No. 62/436,952, filed on Dec. 20, 2016.

(51) Int. Cl.
*E21B 17/07* (2006.01)
*E21B 7/24* (2006.01)

(52) U.S. Cl.
CPC ..... *E21B 17/07* (2013.01); *E21B 7/24* (2013.01)

(58) Field of Classification Search
CPC ..... E21B 17/07; E21B 7/24
See application file for complete search history.

(56) References Cited

U.S. PATENT DOCUMENTS 2,991,635 A * 7/1961 Warren ..... E21B 17/07 464/21
3,949,150 A * 4/1976 Mason ..... E21B 17/07 175/321

(Continued)

FOREIGN PATENT DOCUMENTS

CA 2147063 A1 10/1996
CA 2874639 A1 6/2015
WO 2008/092256 A1 8/2008

OTHER PUBLICATIONS

PCT/US2017/067441 International Search Report and Written Opinion dated May 3, 2018 (16 p.).

(Continued)

*Primary Examiner* — Giovanna Wright
(74) *Attorney, Agent, or Firm* — Conley Rose, P.C.

(57) ABSTRACT

A shock tool for reciprocating a drillstring includes an outer housing and a mandrel assembly coaxially disposed in the outer housing. The outer housing has a radially inner surface including a plurality of circumferentially-spaced splines. The mandrel assembly includes a mandrel having a radially outer surface including a plurality of circumferentially-spaced splines and a plurality of circumferentially-spaced troughs. Each spline of the outer housing is disposed in one trough of the mandrel. Each spline of the mandrel includes a top surface, a first lateral side surface extending radially from the top surface, a second lateral side surface oriented parallel to the first lateral side surface, and a bevel extending from the top surface to the second lateral side surface. Each spline of the mandrel also includes a pocket in the second lateral side surface extending radially from a bottom surface of a trough to the bevel.

20 Claims, 11 Drawing Sheets

(56) References Cited

U.S. PATENT DOCUMENTS

| | | | | |
|---|---|---|---|---|
| 4,186,569 | A | 2/1980 | Aumann | |
| 4,211,290 | A * | 7/1980 | Mason | E21B 17/07 175/321 |
| 2015/0034387 | A1 | 2/2015 | Malcolm et al. | |

OTHER PUBLICATIONS

PCT/US2017/067441 Written Opinion of the International Preliminary Examining Authority dated Nov. 8, 2018 (8 p.).

* cited by examiner

DRILLING OSCILLATION SYSTEMS AND OPTIMIZED SHOCK TOOLS FOR SAME

CROSS-REFERENCE TO RELATED APPLICATIONS

This application claims benefit of U.S. provisional patent application Ser. No. 62/436,952 filed Dec. 20, 2016, and entitled "Optimized Shock Tool for Pressure Pulse (Agitation) Applications," which is hereby incorporated herein by reference in its entirety.

STATEMENT REGARDING FEDERALLY SPONSORED RESEARCH OR DEVELOPMENT

Not applicable.

BACKGROUND

The disclosure relates generally to downhole tools. More particularly, the disclosure relates to downhole oscillation systems for inducing axial oscillations in drill strings during drilling operations. Still more particularly, the disclosure relates to shock tools that directly and efficiently convert cyclical pressure pulses in drilling fluid into axial oscillations.

Drilling operations are performed to locate and recover hydrocarbons from subterranean reservoirs. Typically, an earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone.

During drilling, the drillstring may rub against the sidewall of the borehole. Frictional engagement of the drillstring and the surrounding formation can reduce the rate of penetration (ROP) of the drill bit, increase the necessary weight-on-bit (WOB), and lead to stick slip. Accordingly, various downhole tools that induce vibration and/or axial reciprocation may be included in the drillstring to reduce friction between the drillstring and the surrounding formation. One such tool is an oscillation system, which typically includes an pressure pulse generator and a shock tool. The pressure pulse generator produces pressure pulses in the drilling fluid flowing therethrough and the shock tool converts the pressure pulses in the drilling fluid into axial reciprocation. The pressure pulses created by the pressure pulse generator are cyclic in nature. The continuous stream of pressure peaks and troughs in the drilling fluid cause the shock tool to cyclically extend and retract telescopically at the pressure peak and pressure trough, respectively. A spring is usually used to induce the axial retraction during the pressure trough.

BRIEF SUMMARY OF THE DISCLOSURE

Embodiments of shock tools for reciprocating drillstrings are disclosed herein. In one embodiment, a shock tool for reciprocating a drillstring comprises an outer housing having a central axis, a first end, a second end opposite the first end, and a radially inner surface defining a passage extending axially from the first end to the second end. The radially inner surface of the outer housing includes a plurality of circumferentially-spaced splines. In addition, the shock tool comprises a mandrel assembly coaxially disposed in the passage of the outer housing and configured to move axially relative to the outer housing. The mandrel assembly has a first end axially spaced from the outer housing, a second end disposed in the outer housing, and a passage extending axially from the first end of the mandrel assembly to the second end of the mandrel assembly. The mandrel assembly includes a mandrel having a radially outer surface including a plurality of circumferentially-spaced splines and a plurality of circumferentially-spaced troughs. Each trough of the mandrel is circumferentially disposed between a pair of circumferentially adjacent splines of the plurality of splines of the mandrel. Each spline of the outer housing is disposed in one trough of the mandrel. Each spline of the mandrel includes a radially outer top surface, a first lateral side surface extending radially from the top surface to a bottom surface of a circumferentially adjacent trough of the mandrel, a second lateral side surface extending radially from a circumferentially adjacent trough of the mandrel, and a bevel extending from the top surface to the second lateral side surface. Each spline of the mandrel also includes a pocket in the second lateral side surface extending radially from the corresponding bottom surface to the bevel.

In another embodiment, a shock tool for reciprocating a drillstring comprises an outer housing having a central axis, an upper end, a lower end, and a passage extending axially from the upper end to the lower end. In addition, the shock tool comprises a mandrel assembly disposed in the passage of the outer housing and extending telescopically from the upper end of the outer housing. The mandrel assembly is configured to move axially relative to the outer housing to axially extend and contract the shock tool. Further, the shock tool comprises a biasing member disposed about the mandrel assembly in a first annulus radially positioned between the mandrel assembly and the outer housing. The biasing member is configured to generate an axial biasing force that resists axial movement of the mandrel assembly relative to the outer housing. The biasing member slidably engages the outer housing and is radially spaced from the mandrel assembly. Still further, the shock tool comprises an annular flow passage radially positioned between the biasing member and the mandrel assembly. The annular flow passage extends axially from an upper end of the biasing member to a lower end of the biasing member.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
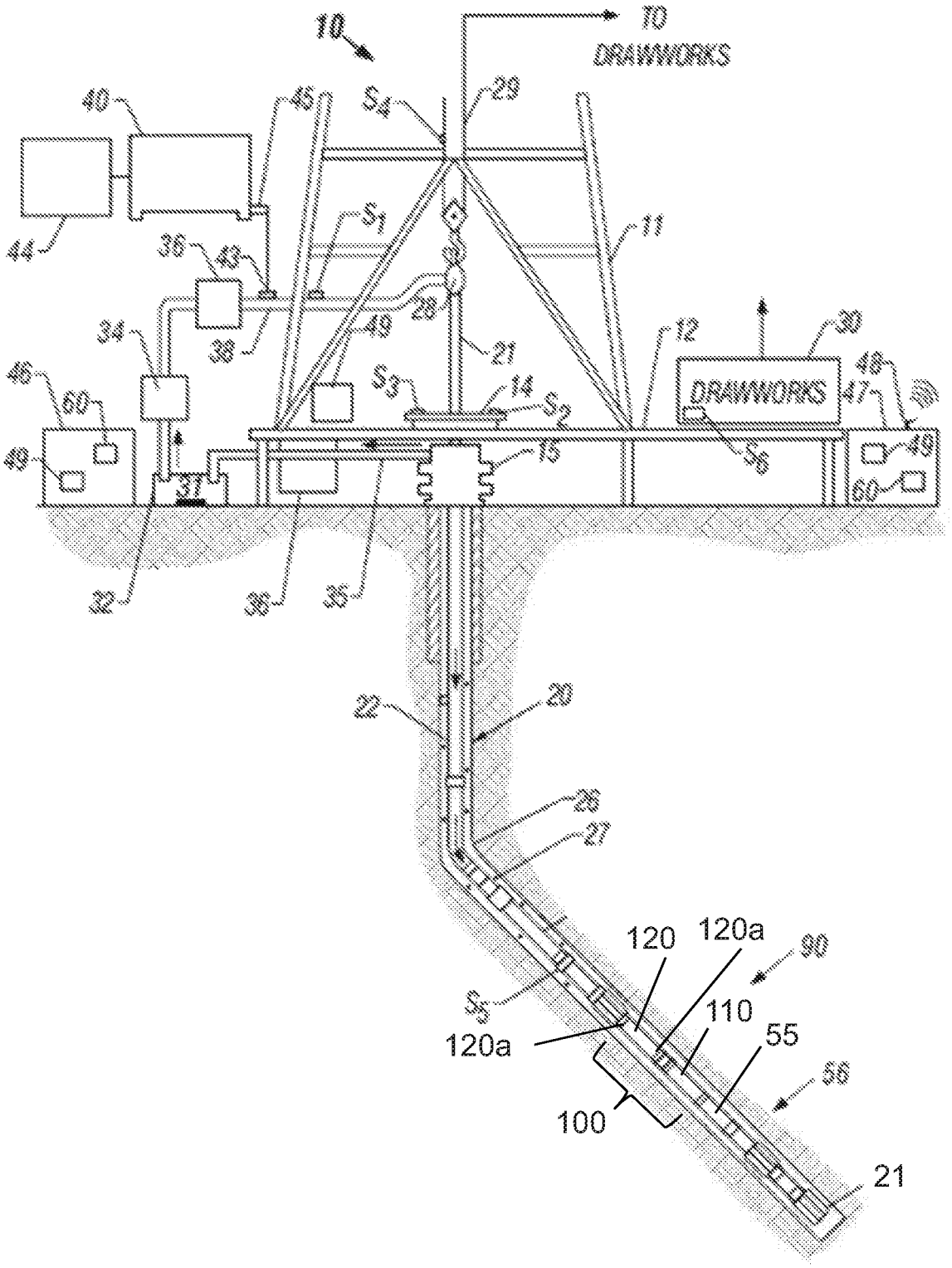
FIG. 1 is a schematic view of a drilling system including an embodiment of an oscillation system in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

Referring now to FIG. 1, a schematic view of an embodiment of a drilling system 10 is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). In other embodiments, the rotary table (e.g., rotary table 14) may be augmented or replaced by a top drive suspended in the derrick (e.g., derrick 11) and connected to the drillstring (e.g., drillstring 20).

Drilling assembly 90 includes a drillstring 20 and a drill bit 21 coupled to the lower end of drillstring 20. Drillstring 20 is made of a plurality of pipe joints 22 connected end-to-end, and extends downward from the rotary table 14 through a pressure control device 15, such as a blowout preventer (BOP), into the borehole 26. Drill bit 21 is rotated with weight-on-bit (WOB) applied to drill the borehole 26 through the earthen formation. Drillstring 20 is coupled to a udrawworks 30 via a kelly joint 21, swivel 28, and line 29 through a pulley. During drilling operations, drawworks 30 is operated to control the WOB, which impacts the rate-of-penetration of drill bit 21 through the formation. In addition, drill bit 21 can be rotated from the surface by drillstring 20 via rotary table 14 and/or a top drive, rotated by downhole mud motor 55 disposed along drillstring 20 proximal bit 21, or combinations thereof (e.g., rotated by both rotary table 14 via drillstring 20 and mud motor 55, rotated by a top drive and the mud motor 55, etc.). For example, rotation via downhole motor 55 may be employed to supplement the rotational power of rotary table 14, if required, and/or to effect changes in the drilling process. In either case, the rate-of-penetration (ROP) of the drill bit 21 into the borehole 26 for a given formation and a drilling assembly largely depends upon the WOB and the rotational speed of bit 21.

During drilling operations a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through mud motor 55 and is discharged at the borehole bottom through nozzles in face of drill bit 21, circulates to the surface through an annulus 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

While drilling, one or more portions of drillstring 20 may contact and slide along the sidewall of borehole 26. To reduce friction between drillstring 20 and the sidewall of borehole 26, in this embodiment, an oscillation system 100 is provided along drillstring 20 proximal motor 55 and bit 21. Oscillation system 100 includes a pressure pulse generator 110 coupled to motor 55 and a shock tool 120 coupled to pulse generator 110. Pulse generator 110 generates cyclical pressure pulses in the drilling fluid flowing down drillstring 20, and shock tool 120 cyclically and axially extends and retracts in response to the pressure pulses as will be described in more detail below. With bit 21 disposed on the hole bottom, the axial extension and retraction of shock tool 120 induces axial reciprocation in the portion of drillstring above oscillation system 100, which reduces friction between drillstring 20 and the sidewall of borehole 26.

In general, pulse generator 110 and mud motor 55 can be any pressure pulse generator and mud motor, respectively, known in the art. For example, as is known in the art, pulse generator 110 can be a valve operated to cyclically open and close as a rotor of mud motor 55 rotates within a stator of mud motor 55. When the valve opens, the pressure of the drilling mud upstream of pulse generator 110 decreases, and when the valve closes, the pressure of the drilling mud upstream of pulse generator 110 increases. Examples of such valves are disclosed in U.S. Pat. Nos. 6,279,670, 6,508,317, 6,439,318, and 6,431,294, each of which is incorporated herein by reference in its entirety for all purposes.

Figure 2:
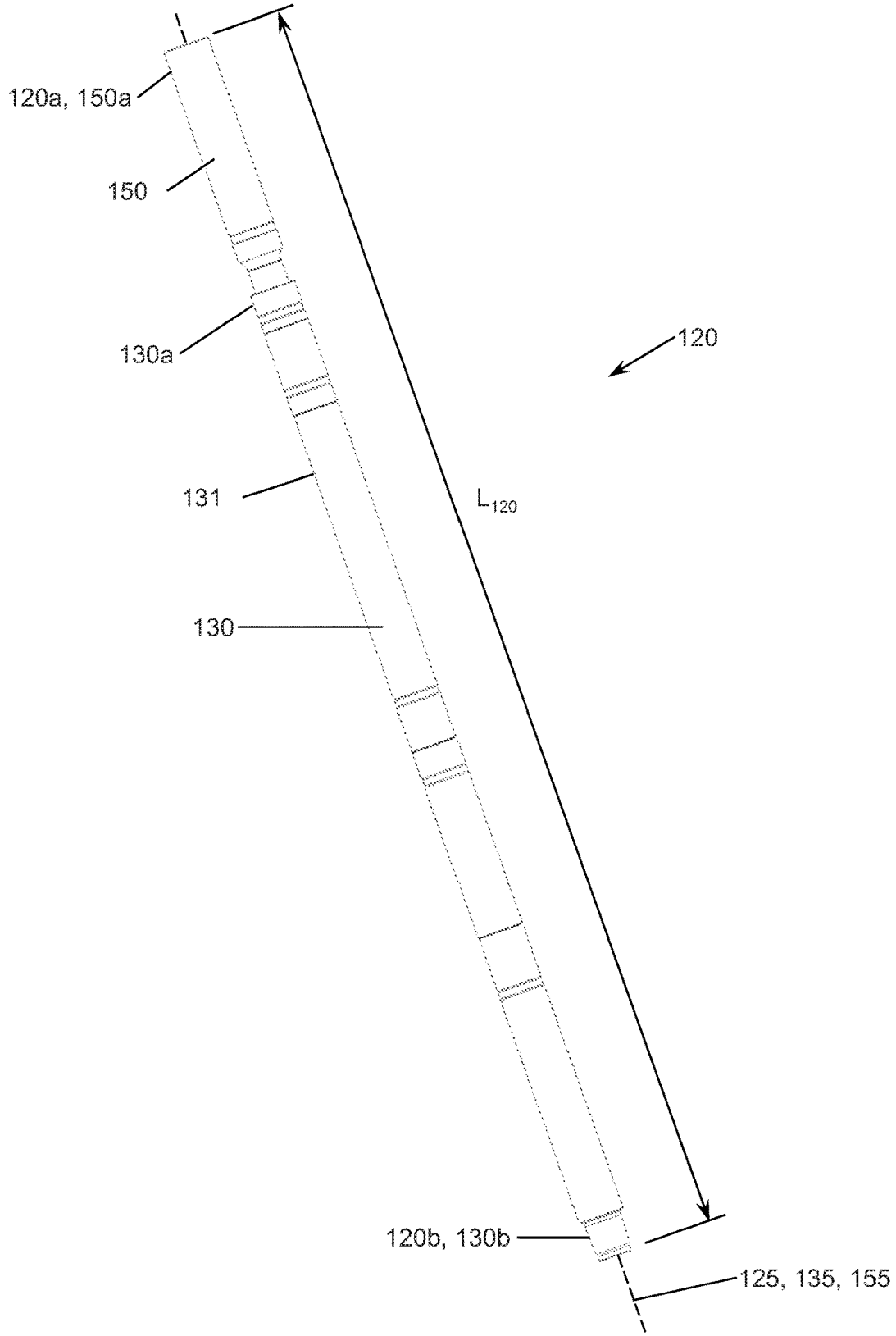
FIG. 2 is a side view of the shock tool of the oscillation system of FIG. 1.
Figure 3:
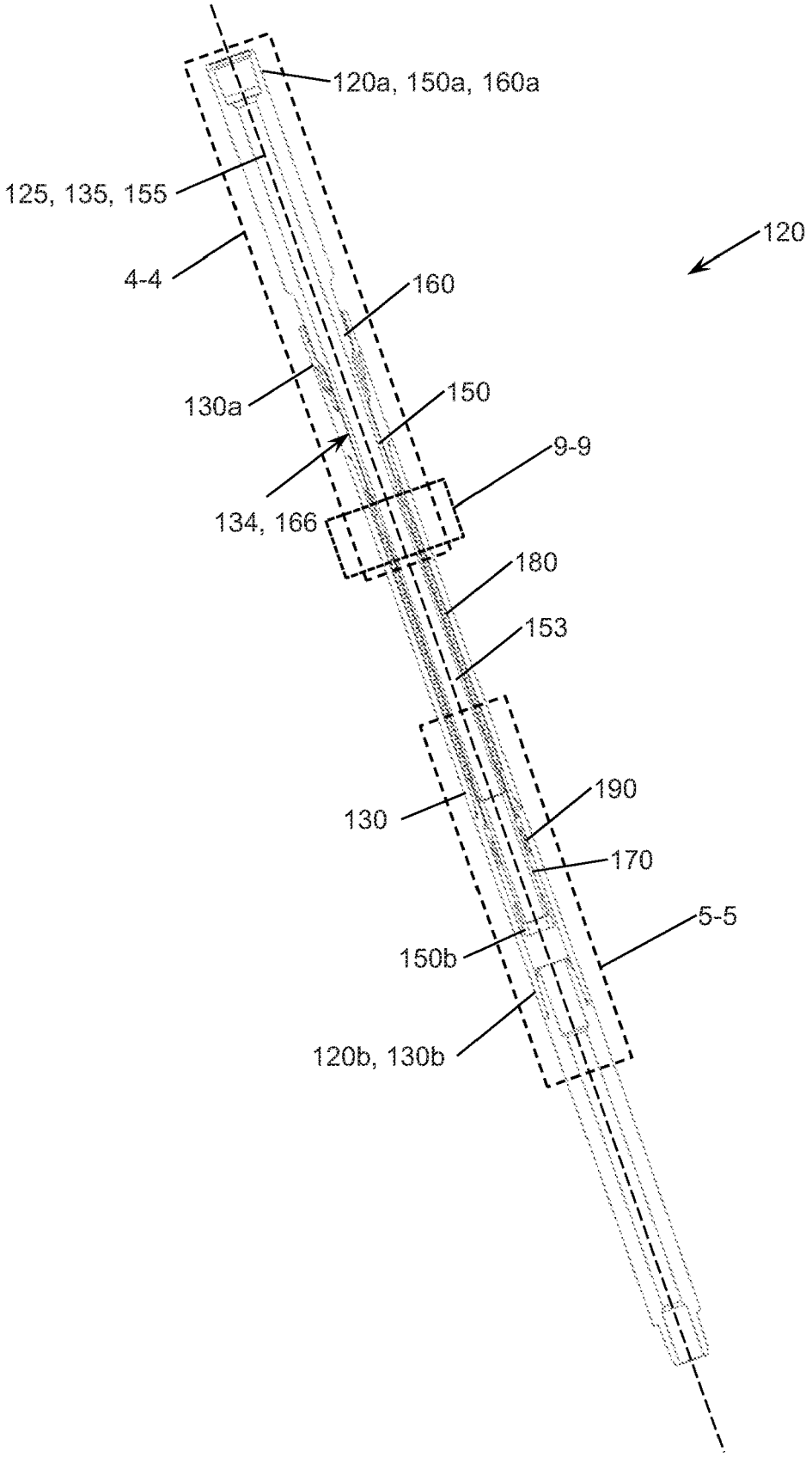
FIG. 3 is a cross-sectional side view of the shock tool of FIG. 2.

Referring now to FIGS. 2 and 3, shock tool 120 of oscillation system 100 is shown. Shock tool 120 has a first or uphole end 120*a*, a second or downhole end 120*b* opposite end 120*a*, and a central or longitudinal axis 125. As shown in FIG. 1, uphole end 120*a* is coupled to the portion of drillstring 20 disposed above oscillation system 100 and downhole end 120*b* is coupled to pulse generator 110. Tool 120 has a length $L_{120}$ measured axially from upper end 120*a* to lower end 120*b*. As will be described in more detail below, shock tool 120 cyclically axially extends and retracts in response to the pressure pulses in the drilling fluid generated by pulse generator 110 during drilling operations. During extension of tool 120, ends 120*a*, 120*b* move axially away from each other and length $L_{120}$ increases, and during contraction of tool 120, ends 120*a*, 120*b* move axially toward each other and length $L_{120}$ decreases. Thus, shock tool 120 may be described as having an "extended" position with ends 120*a*, 120*b* axially spaced apart to the greatest extent (i.e., when length $L_{120}$ is at a maximum) and a retracted position with ends 120*a*, 120*b* axially spaced apart to the smallest extent (i.e., when length $L_{120}$ is at a minimum).

Referring still to FIGS. 2 and 3, in this embodiment, shock tool 120 includes an outer housing 130, a mandrel assembly 150 telescopically disposed within outer housing 130, a biasing member 180 disposed about mandrel assembly 150 within outer housing 130, and an annular floating piston 190 disposed about mandrel assembly 150 within outer housing 130. Thus, biasing member 180 and floating piston 190 are radially positioned between mandrel assembly 150 and outer housing 130. Mandrel assembly 150 and outer housing 130 are tubular members, each having a central or longitudinal axis 155, 135, respectively, coaxially aligned with axis 125 of shock tool 120. Mandrel assembly 150 can move axially relative to outer housing 130 to enable the cyclical axial extension and retraction of shock tool 120. Biasing member 180 axially biases mandrel assembly 150 and shock tool 120 to a "neutral" position between the extended position and the retracted position. As will be described in more detail below, floating piston 190 is free to move axially along mandrel assembly 150 and defines a barrier to isolate biasing member 180 and hydraulic oil from drilling fluids.

Figure 4:
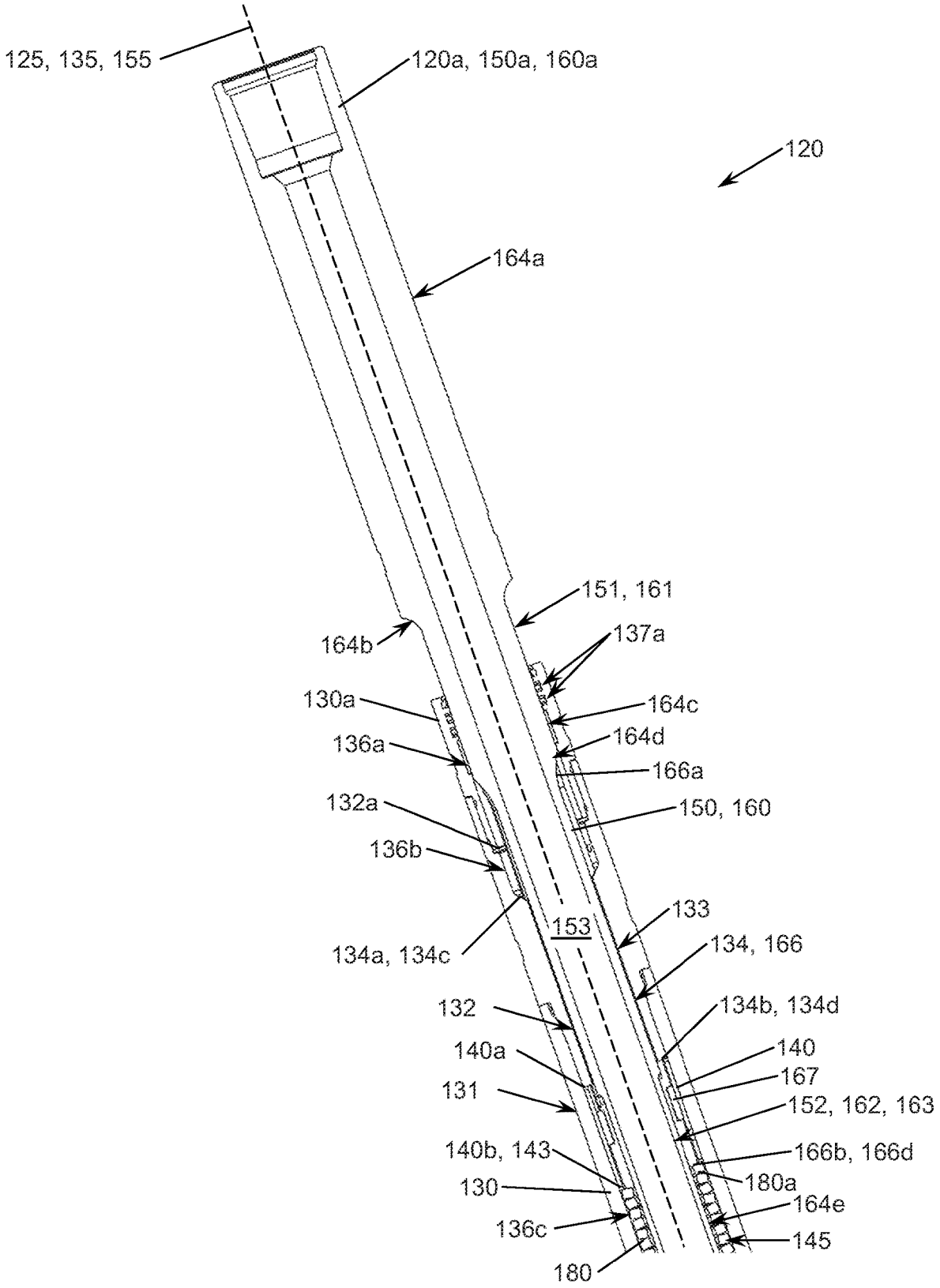
FIG. 4 is an enlarged cross-sectional side view of the shock tool of FIG. 2 taken in section 4-4 FIG. 3.
Figure 5:
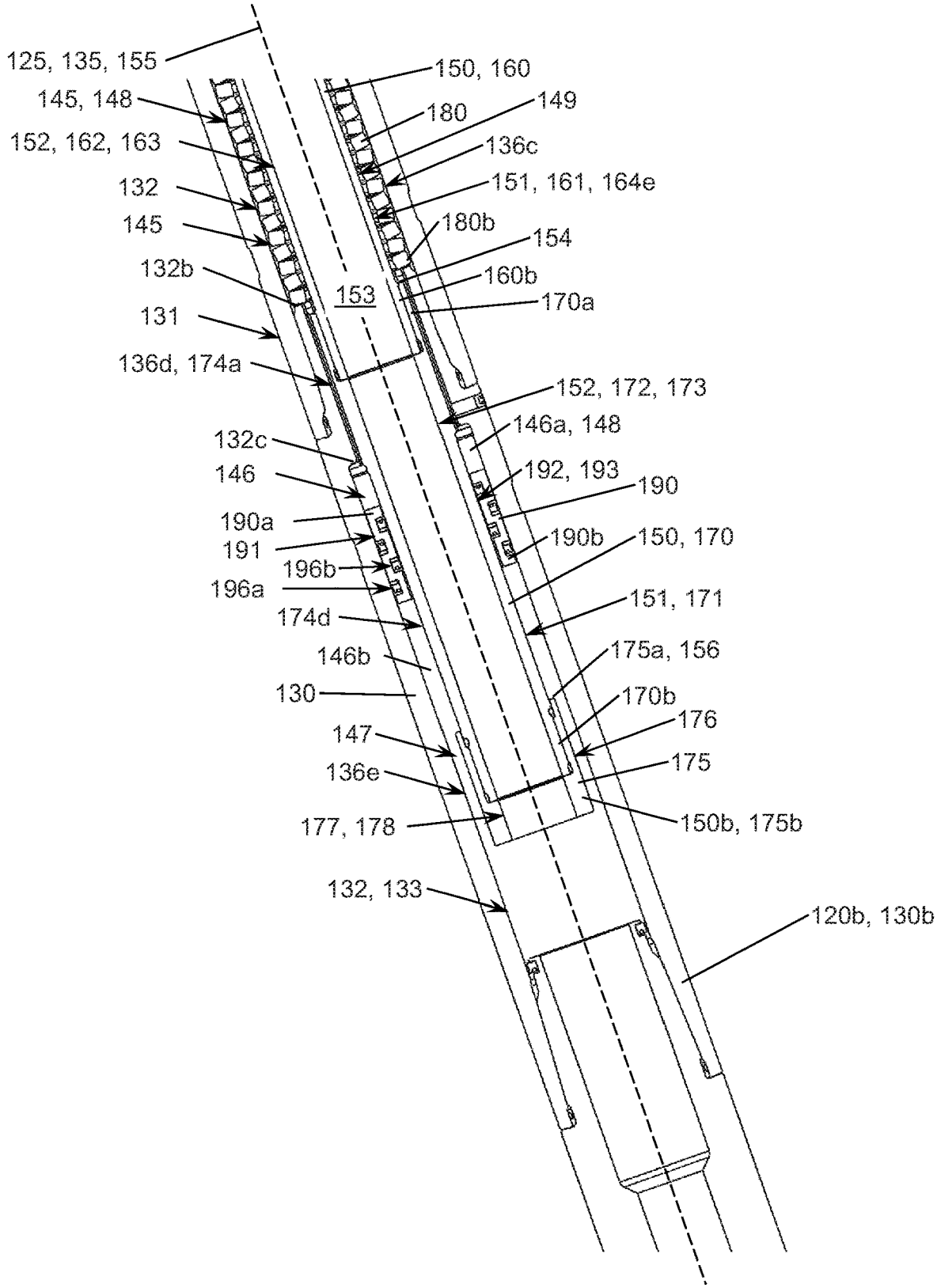
FIG. 5 is an enlarged cross-sectional side view of the shock tool of FIG. 2 taken in section 5-5 of FIG. 3.
Figure 6:
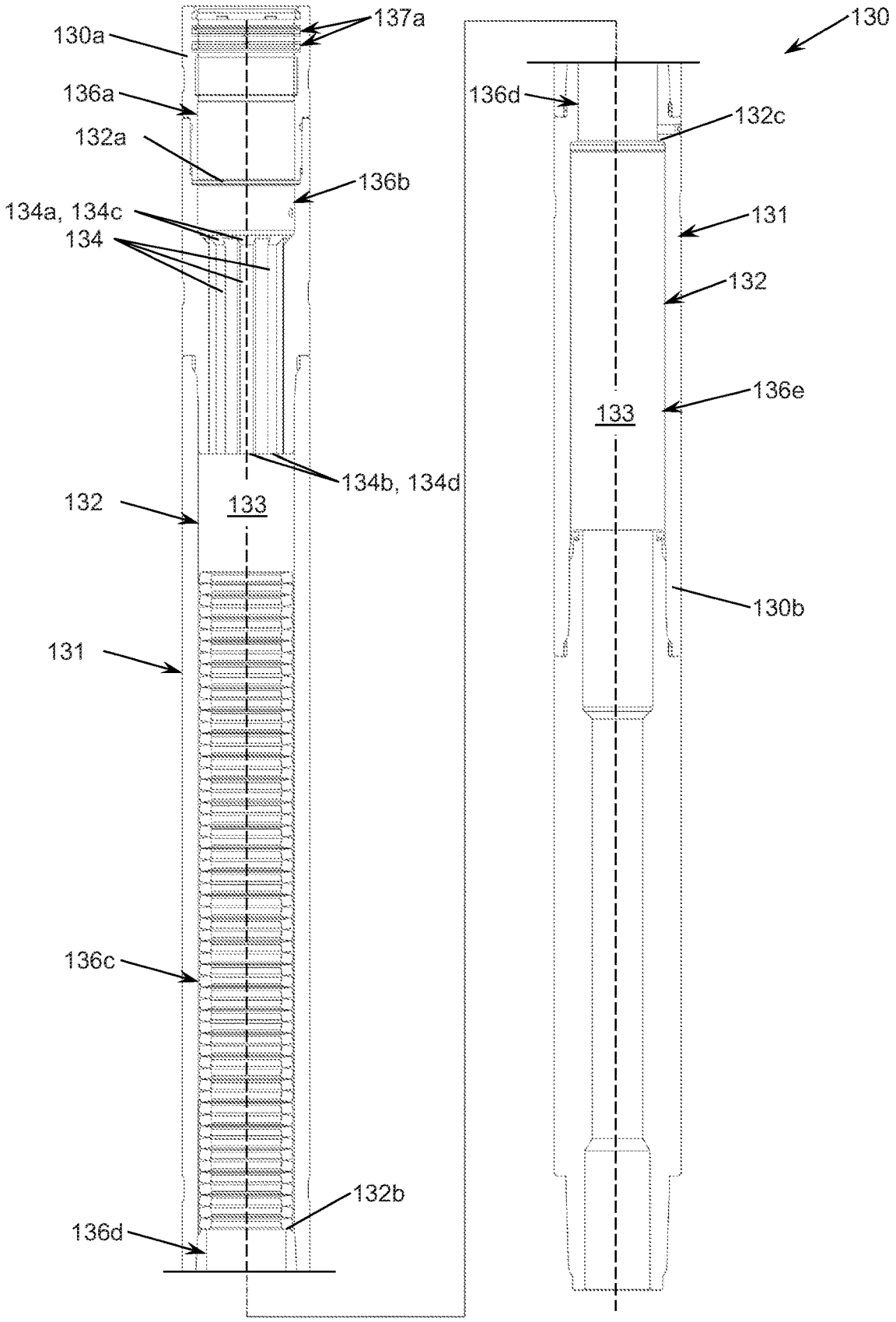
FIG. 6 is a cross-sectional side view of the outer housing and the biasing member of the shock tool of FIG. 3.

Referring now to FIGS. 4-6, outer housing 130 has a first or uphole end 130*a*, a second or downhole end 130*b* opposite end 130*a*, a radially outer surface 131 extending axially between ends 130*a*, 130*b*, and a radially inner surface 132 extending axially between ends 130*a*, 130*b*. Uphole end 130*a* is axially positioned below uphole end 120*a* of shock tool 120. However, downhole end 130*b* is coincident with, and hence defines downhole end 120*b* of shock tool 120.

Inner surface 132 defines a central throughbore or passage 133 extending axially through housing 130 (i.e., from uphole end 130*a* to downhole end 130*b*). Outer surface 131 is disposed at a radius that is uniform or constant moving axially between ends 130*a*, 130*b*. Thus, outer surface 131 is generally cylindrical between ends 130*a*, 130*b*. Inner surface 132 is disposed at a radius that varies moving axially between ends 130*a*, 130*b*.

In this embodiment, outer housing 130 is formed with a plurality of tubular members connected end-to-end with mating threaded connections (e.g., box and pin connections). Some of the tubular members forming outer housing 130 define annular shoulders along inner surface 132. In particular, moving axially from uphole end 130*a* to downhole end 130*b*, inner surface 132 includes a frustoconical uphole facing annular shoulder 132*a*, an uphole facing annular shoulder 132*b*, and a downward facing planar annular shoulder 132*c*. In addition, inner surface 132 includes a plurality of circumferentially-spaced parallel internal splines 134 axially positioned between shoulders 132*a*, 132*b*. As will be described in more detail below, splines 134 slidingly engage mating external splines on mandrel assembly 150, thereby allowing mandrel assembly 150 to move axially relative to outer housing 130 but preventing mandrel assembly 150 from rotating about axis 125 relative to outer housing 130. Each spline 134 extends axially between a first or uphole end 134*a* and a second or downhole end 134*b*. The uphole ends 134*a* of splines 134 define a plurality of circumferentially-spaced uphole facing frustoconical shoulders 134*c* extending radially into passage 133, and the downhole ends 134*b* of splines 134 define a plurality of circumferentially-spaced downhole facing planar shoulders 134*d* extending radially into passage 133.

Referring still to FIGS. 4-6, inner surface 132 also includes a cylindrical surface 136*a* extending axially from end 130*a* to shoulder 132*a*, a cylindrical surface 136*b* extending axially between shoulders 132*a*, 134*c*, a cylindrical surface 136*c* extending axially between shoulders 134*d*, 132*b*, a cylindrical surface 136*d* extending axially between shoulders 132*b*, 132*c*, and a cylindrical surface 136*e* extending axially between shoulders 132*c*, 132*d*.

Along each cylindrical surface 136*a*, 136*b*, 136*c*, 136*d*, 136*e* the radius of inner surface 132 is constant and uniform, however, since shoulders 132*a*, 132*b*, 132*c*, 134*c*, 134*d* extend radially, the radius of inner surface 132 along different cylindrical surfaces 136*a*, 136*b*, 136*c*, 136*d*, 136*e* may vary. As best shown in FIGS. 4-6, and as will be described in more detail below, cylindrical surfaces 136*a*, 136*d* slidingly engage mandrel assembly 150, whereas cylindrical surfaces 136*b*, 136*c*, 136*e* are radially spaced from mandrel assembly 150. In this embodiment, a plurality of axially spaced annular seal assemblies 137*a* are disposed along cylindrical surface 136*a* and radially positioned between mandrel assembly 150 and outer housing 130. Seal assemblies 137*a* form annular seals between mandrel assembly 150 and outer housing 130, thereby preventing fluids from flowing axially between cylindrical surface 136*a* and mandrel assembly 150. Thus, seal assemblies 137*a* prevent fluids from inside housing 130 from flowing upwardly between mandrel assembly 150 and end 130*a* into annulus 27 during drilling operations, and prevent fluids in annulus 27 from flowing between mandrel assembly 150 and end 130*a* into housing 130.

Figure 7:
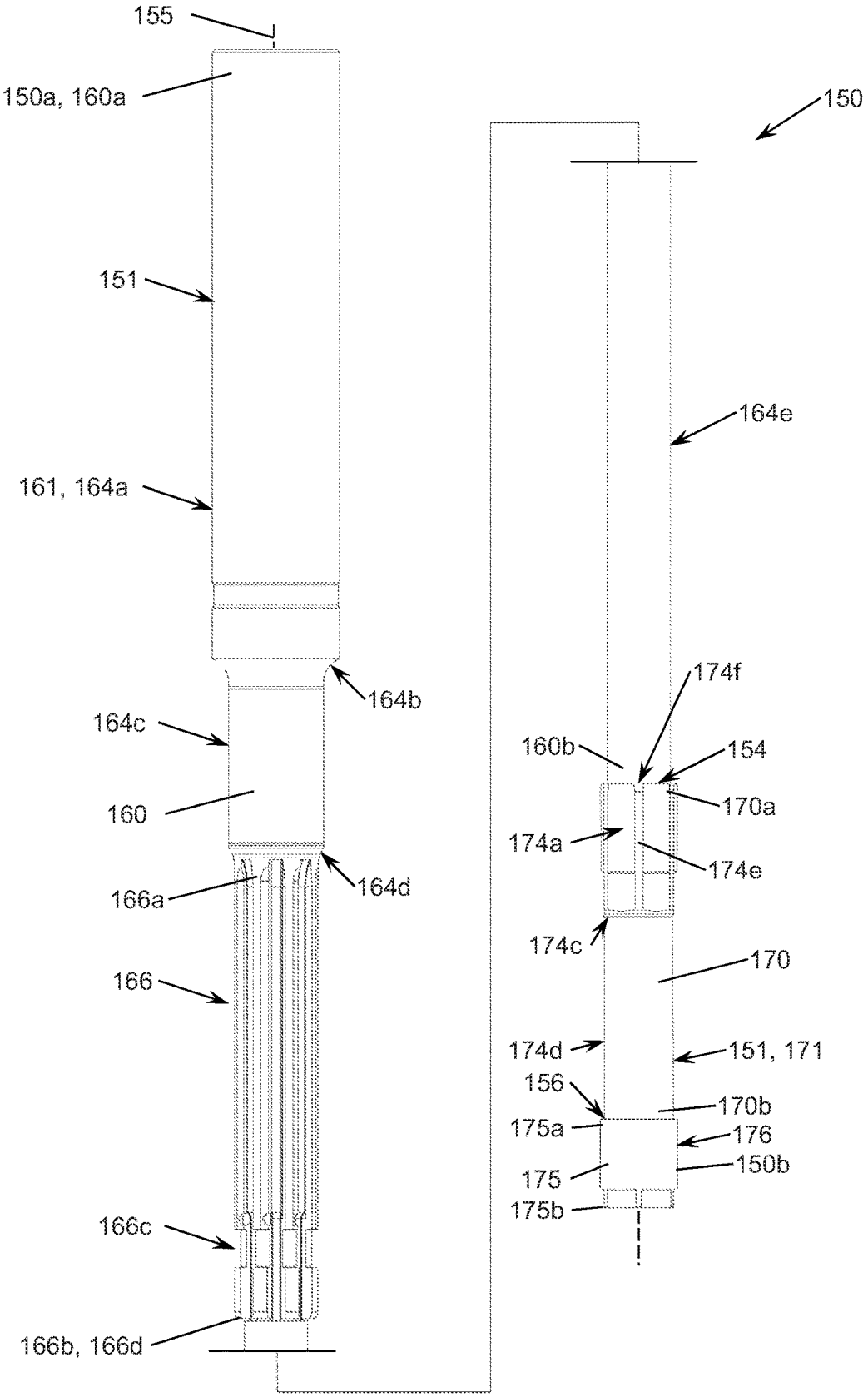
FIG. 7 is a side view of the mandrel assembly of the shock tool of FIG. 3.

Referring now to FIGS. 4, 5, and 7, mandrel assembly 150 has a first or uphole end 150*a*, a second or downhole end 150*b* opposite end 150*a*, a radially outer surface 151 extending axially between ends 150*a*, 150*b*, and a radially inner surface 152 extending axially between ends 150*a*, 150*b*. Uphole end 150*a* is coincident with, and hence defines uphole end 120*a* of shock tool 120. In addition, uphole end 150*a* is axially positioned above uphole end 130*a* of outer housing 130. Downhole end 150*b* is disposed without outer housing 130 and axially positioned above downhole end 130*b*. Inner surface 152 defines a central throughbore or passage 153 extending axially through mandrel assembly 150 (i.e., from uphole end 150*a* to downhole end 150*b*). Inner surface 152 is disposed at a radius that is uniform or constant moving axially between ends 150*a*, 150*b*. Thus, inner surface 152 is generally cylindrical between ends 150*a*, 150*b*. Outer surface 151 is disposed at a radius that varies moving axially between ends 150*a*, 150*b*. In this embodiment, mandrel assembly 150 includes a mandrel 160 and a tubular member or washpipe 170 coupled to mandrel 160. Mandrel 160 and washpipe 170 are connected end-to-end and are coaxially aligned with axis 155.

Referring still to FIGS. 4, 5, and 7, mandrel 160 has a first or uphole end 160*a*, a second or downhole end 160*b* opposite end 160*a*, a radially outer surface 161 extending axially between ends 160*a*, 160*b*, and a radially inner surface 162 extending axially between ends 160*a*, 160*b*. Uphole end 160*a* is coincident with, and hence defines uphole end 150*a* of mandrel assembly 150. Inner surface 162 is a cylindrical surface defining a central throughbore or passage 163 extending axially through mandrel 160. Inner surface 162 and passage 163 define a portion of inner surface 152 and passage 153, respectively, of mandrel assembly 150.

Moving axially from uphole end 160*a*, outer surface 161 includes a cylindrical surface 164*a*, extending from end 160*a*, a concave downhole facing annular shoulder 164*b*, a cylindrical surface 164*c* extending from shoulder 164*b*, an annular downhole facing annular shoulder 164*d*, a plurality circumferentially-spaced parallel external splines 166, and a cylindrical surface 164*e* axially positioned between splines 166 and downhole end 160*b*. A portion of outer surface 161 extending from downhole end 160*b* includes external threads that threadably engage mating internal threads of washpipe 170.

As best shown in FIG. 7, splines 166 are axially positioned between shoulder 164*d* and cylindrical surface 164*e*. Each spline 166 extends axially between a first or uphole end 166*a* proximal shoulder 164*d* and a second or downhole end 166*b* distal shoulder 164*d*. In this embodiment, each spline 166 includes a recess 166*c* positioned proximal downhole end 166*b*. Recesses 166*c* are disposed at the same axial position along splines 166 and circumferentially aligned. A lock ring 167 is dispose about splines 166 (and mandrel 160) and seated in recesses 166*c*. Lock ring 167 functions as a shouldering mechanism to limit the upward travel of mandrel 160 relative to housing 130. In particular, as best shown in FIG. 4, mandrel 160 can move axially upward relative to housing 130 until lock ring 167 axially engages shoulders 134*d* at lower ends 134*b* of splines 134, thereby preventing further axial upward movement of mandrel 160 relative to housing 130. Limiting the upward travel of the mandrel 160 relative to housing 130 reduces the likelihood of overstressing biasing member 180. In this embodiment, the upward travel of mandrel 160 relative to housing 130 is limited to about 1.0 in.

Referring again to FIGS. 4, 5, and 7, the downhole ends 166*b* of splines 166 define a plurality of circumferentially-spaced downhole facing planar shoulders 166*d*. Splines 166 of mandrel 160 slidingly engage mating splines 134 of outer housing 130, thereby allowing mandrel assembly 150 to move axially relative to outer housing 130 but preventing mandrel assembly 150 from rotating about axis 125 relative to outer housing 130. Thus, engagement of mating splines 134, 166 enables the transfer of rotation torque between mandrel assembly 150 and outer housing 130 during drilling operations.

Washpipe 170 has a first or uphole end 170*a*, a second or downhole end 170*b* opposite end 170*a*, a radially outer surface 171 extending axially between ends 170*a*, 170*b*, and a radially inner surface 172 extending axially between ends 170*a*, 170*b*. Inner surface 172 is a cylindrical surface defining a central throughbore or passage 173 extending axially through washpipe 170. Inner surface 172 and passage 173 define a portion of inner surface 152 and passage 153, respectively, of mandrel assembly 150. A portion of inner surface 172 extending axially from uphole end 170*a* includes internal threads that threadably engage the mating external threads provided at downhole end 160*b* of mandrel 160, thereby fixably securing mandrel 160 and washpipe 170 end-to-end. With end 160*b* of mandrel 160 threaded into uphole end 170*a* of washpipe 170, end 170*a* defines an annular uphole facing planar shoulder 154 along outer surface 151.

As best shown in FIGS. 5 and 7, moving axially from uphole end 170*a* toward downhole end 170*b*, outer surface 171 includes a cylindrical surface 174*a* extending from end 170*a*, a plurality of uniformly circumferentially-spaced flats 174*b* axially adjacent cylindrical surface 174*a*, a downhole facing planar annular shoulder 174*c*, and a cylindrical surface 174*d* extending from shoulder 174*c*. A portion of outer surface 171 at downhole end 170*b* includes external threads that threadably engage mating internal threads of an annular catch 175. Catch 175 is disposed about downhole end 170*b* of washpipe 170 and extends axially therefrom. Catch 175 has a first or uphole end 175*a*, a second or downhole end 175*b* opposite end 175*a*, a radially outer surface 176 extending axially between ends 175*a*, 175*b*, and a radially inner surface 177 extending axially between ends 175*a*, 175*b*. Inner surface 177 defines a central throughbore or passage 178 extending axially through piston 175. Inner surface 177 and passage 178 define a portion of inner surface 152 and passage 153, respectively, of mandrel assembly 150. A portion of inner surface 177 extending axially from upper end 175*a* includes internal threads that threadably engage the mating external threads provided at downhole end 170*b* of washpipe 170, thereby fixably securing catch 175 to downhole end 170*b* of washpipe 170. With end 170*b* of washpipe 170 threaded into catch 175, the uphole end 175*a* of catch 175 defines an annular uphole facing planar shoulder 156 along outer surface 151. In this embodiment, outer surface 176 is radially spaced from inner surface 132 of housing 130 as shown in FIG. 5.

Referring now to FIGS. 4 and 5, mandrel assembly 150 is disposed within outer housing 130 with mating splines 134, 166 intermeshed and slidingly engaging, and uphole ends 150*a*, 160*a* positioned above end 130*a* of housing 130. In addition, cylindrical surfaces 136*a*, 164*c* slidingly engage with annular seal assemblies 137*a* sealingly engaging surface 164*c* of mandrel 160, and cylindrical surfaces 136*d*, 174*a* slidingly engage. Cylindrical surfaces 136*d*, 174*a* are radially adjacent one another, however, seals are not provided between surfaces 136*d*, 174*a*. Thus, although surfaces 136*d*, 174*a* may slidingly engage, fluid can flow therebetween. Cylindrical surface 136*c* of outer housing 130 is radially opposed to the lower portions of external splines 166 of mandrel 160 but radially spaced therefrom. An annular sleeve 140 is positioned about the lower portions of external splines 166 and axially abuts shoulders 134*d* defined by the downhole ends 134*b* of internal splines 134. In particular, sleeve 140 has a first or uphole end 140*a* engaging shoulders 134*d*, a second or downhole end 140*b* proximal shoulders 166*d* defined by the downhole ends 166*b* of external splines 160, a radially outer cylindrical surface slidingly engaging cylindrical surface 136*c*, and a radially inner cylindrical surface slidingly engaging splines 166. As will be described in more detail below, downhole end 140*b* defines an annular downhole facing planar shoulder 143 within housing 130.

Cylindrical surfaces 136*c*, 164*e* of outer housing 130 and mandrel 160, respectively, are radially opposed and radially spaced apart; cylindrical surfaces 136*e*, 174*d* of outer housing 130 and washpipe 170, respectively, are radially opposed and radially spaced apart; and cylindrical surfaces 136*e*, 176 of outer housing 130 and catch 175, respectively, are radially opposed and radially spaced apart. As a result, shock tool 120 includes a first annular space or annulus 145, a second annular space or annulus 146 axially positioned below annulus 140, and a third annular space or annulus 147 axially positioned below annulus 146. Annulus 145 is radially positioned between surfaces 136*c*, 164*e* and extends axially from the axially lower of shoulder 143 of sleeve 140 and shoulders 166*d* of splines 166 to the axially upper of shoulder 132*b* of housing 130 and shoulder 154 of mandrel assembly 150 (depending on the relatively axial positions of mandrel assembly 150 and outer housing 130). Annulus 146 is radially position between surfaces 136*e*, 174*d* and extends axially from shoulder 132*c* of housing 130 to shoulder 156 defined by upper end 175*a* of catch 175. Annulus 147 is radially positioned between surfaces 136*e*, 176 and extends axially from shoulder 156 of catch 175 to lower ends 150*b*, 175.

Referring still to FIGS. 4 and 5, biasing member 180 is disposed about mandrel assembly 150 and positioned in annulus 145. Biasing member 180 has a first or uphole end 180*a* proximal shoulders 143, 166*d* and a second or downhole end 180*b* proximal shoulder 132*b*, 154. Biasing member 180 has a central axis coaxially aligned with axes 125, 135, 155. In this embodiment, biasing member 180 is a stack of Belleville springs.

Biasing member 180 is axially compressed within annulus 145 with its uphole end 180*a* axially bearing against the lowermost of shoulder 143 of sleeve 140 and shoulders 166*d* of splines 166, and its downhole end 180*b* axially bearing against the uppermost of shoulder 132*b* of housing 130 and shoulder 154 defined by upper end 170*a* of washpipe 170. More specifically, during the cyclical axial extension and retraction of shock tool 120, mandrel assembly 150 moves axially uphole and downhole relative to outer housing 130. As mandrel assembly 150 moves axially uphole relative to outer housing 130, biasing member 180 is axially compressed between shoulders 154, 143 as shoulder 154 lifts end 180*b* off shoulder 132*b* and shoulders 166*d* move axially upward and away from shoulder 143 and end 180*a*. As a result, the axial length of biasing member 180 measured axially between ends 180*a*, 180*b* decreases and biasing member 180 exerts an axial force urging shoulders 154, 143 axially apart (i.e., urges shoulder 154 axially downward toward shoulder 132*b* and urges shoulder 143 axially upward toward shoulders 166*d*). As mandrel assembly 150 moves axially downhole relative to outer housing 130, biasing member 180 is axially compressed between shoulders 166*d*, 132*b* as shoulders 166*d* push end 180*a* downward and shoulder 154 moves axially downward and away from shoulder 132*b* and end 180*b*. As a result, the axial length of biasing member 180 measured axially between ends 180*a*, 180*b* decreases and biasing member 180 exerts an axial force urging shoulders 166*d*, 132*b* axially apart (i.e., urges shoulders 166*d* axially upward toward shoulder 143 and urges shoulder 132*b* axially downward toward shoulder 154). Thus, when shock tool 120 axially extends or contracts, biasing member 180 biases shock tool 120 and mandrel assembly 150 to a "neutral" position with shoulders 132*b*, 154 disposed at the same axial position engaging end 180*b* of biasing member 180, and shoulders 143, 166*d* disposed at the same axial position engaging end 180*a* of biasing member 180. In this embodiment, biasing member 180 is preloaded (i.e., in compression) with tool 120 in the neutral position such that biasing member 180 provides a restoring force urging tool 120 to the neutral position upon any axial extension or retraction of tool 120 (i.e., upon any relative axial movement between mandrel assembly 150 and outer housing 130).

Referring now to FIG. 5, annular piston 190 is disposed about washpipe 170 of mandrel assembly 150 and positioned in annulus 146. Accordingly, piston 190 divides annulus 146 into a first or uphole section 146*a* extending axially from shoulder 132*c* to piston 190 and a second or downhole section 146*b* extending axially from piston 190 to shoulder 156. Piston 190 has a first or uphole end 190*a*, a second or downhole end 190*b* opposite end 190*a*, a radially outer surface 191 extending axially between ends 190*a*, 190*b*, and a radially inner surface 192 extending axially between ends 190*a*, 190*b*. Piston 190 has a central axis coaxially aligned with axes 125, 135, 155.

Inner surface 192 is a cylindrical surface defining a central throughbore or passage 193 extending axially through piston 190 between ends 190*a*, 190*b*. Washpipe 170 extends though passage 193 with cylindrical surfaces 174*d*, 192 slidingly engaging. Outer surface 191 is a cylindrical surface that slidingly engages cylindrical surface 136*e* of outer housing 130.

A plurality of annular seal assemblies 196*a* are disposed along outer cylindrical surface 191 and radially positioned between piston 190 and outer housing 130, and plurality of annular seal assemblies 196*b* is disposed along inner cylindrical surface 192 and radially positioned between piston 190 and washpipe 170. Seal assemblies 196*a* forms annular seals between piston 190 and outer housing 130, thereby preventing fluids from flowing axially between cylindrical surfaces 191, 136*e*. Seal assemblies 196*b* forms annular seals between piston 190 and mandrel assembly 150, thereby preventing fluids from flossing axially between cylindrical surfaces 174*d*, 192.

As previously described, annulus 147 is in fluid communication with annulus 146, and in particular, downhole section 146*b* of annulus 146, however, shoulder 156 extends radially to a radius greater than inner surface 192 of piston 190. Thus, shoulder 156 defined by catch 175 prevents annular piston 190 from sliding off washpipe 170 and exiting annulus 146.

Referring again to FIGS. 4 and 5, as previously described, seal assemblies 137*a* seal between mandrel assembly 150 and outer housing 130 at uphole end 130*a*, and seal assemblies 196*a*, 196*b* and piston 190 seal between mandrel assembly 150 and outer housing 130 axially below splines 134, 166 and biasing member 180. To facilitate relatively low friction, smooth relative movement between mandrel assembly 150 and outer housing and to isolate splines 134, 166 and biasing member 180 from drilling fluid, splines 134, 166 and biasing member 180 are bathed in hydraulic oil. In particular, the annuli and passages radially positioned between mandrel assembly 150 and outer housing 130 and extending axially between seal assemblies 137*a* and seal assemblies 196*a*, 196*b* define a hydraulic oil chamber 148 filled with hydraulic oil. Thus, uphole section 146*a* of annulus 146, annulus 145, the passages between annuli 146, 145 (e.g., between cylindrical surfaces 136*d*, 174*a*), and the passages between splines 134, 166 are included in chamber 148, are in fluid communication with each other, and are filled with hydraulic oil.

Floating piston 190 is free to move axially within annulus 146 along washpipe 170 in response to pressure differentials between portions 146*a*, 146*b* of annulus 146. Thus, floating piston 190 allows shock tool 120 to accommodate expansion and contraction of the hydraulic oil in chamber 148 due to changes in downhole pressures and temperatures without over pressurizing seal assemblies 137*a*, 196*a*, 196*b*. In this embodiment, hydraulic oil chamber 148 is pressure balanced with the drilling fluid flowing down drillstring 20 and passage 153 of mandrel assembly 150. More specifically, lower portion 146*b* of annulus 146 is in fluid communication with passage 153 at lower end 150*b* via annulus 147, and thus, is at the same pressure as drilling fluid in passage 153 at lower end 150*b*. Thus, piston 190 will move axially in annulus 146 until the pressure of the hydraulic oil in chamber 148 is the same as the pressure of the drilling fluid in passage 153 proximal lower end 150*b*.

Referring briefly to FIG. 1, during drilling operations, drilling fluid (or mud) is pumped from the surface down drillstring 20. The drilling fluid flows through oscillation system 100 to bit 21, and then out the face of bit 21 into the open borehole 26. The drilling fluid exiting bit 21 flows back to the surface via the annulus 27 between the drillstring 20 and borehole sidewall. In general, at any given depth in borehole 26, the drilling fluid pumped down the drillstring 20 is at a higher pressure than the drilling fluid in annulus 27, which enables the continuous circulation of drilling fluid. The drilling fluid flowing through mud motor 55 actuates pulse generator 110, which generates cyclical pressure pulses in the drilling fluid flowing down drillstring 20. More specifically, the pressure pulses generated by pulse generator 110 are transmitted through the drilling fluid upstream into shock tool 120.

Referring now to FIG. 5, downhole end 190*b* of piston 190 faces and directly contacts drilling fluid flowing through passage 153 of mandrel assembly 150, while uphole end 190*a* of piston 190 faces and directly contacts the hydraulic oil in chamber 148. Seal assemblies 196*a*, 196*b* prevent fluid communication between the hydraulic oil in chamber 148 and the drilling fluid flowing through passage 153. Pressure pulses generated by pulse generator 110 are transmitted to the drilling fluid in annulus 147 and act on lower end 190*b* of piston 190, thereby generating reciprocal pressure differentials across piston 190. The cyclical increases and decreases in the pressure differentials across piston 190 generate abrupt increases and decreases in the axial forces applied to piston 190. Piston 190 moves axially in response to the cyclical increases and decreases in the pressure differentials, and generates cyclical pressure waves that move upward through the hydraulic oil in hydraulic oil chamber 148 and acts on shoulder 164*d* of mandrel 160 and seals 137*a* to axially reciprocate mandrel assembly 150 relative to outer housing 130. As previously described, the biasing member 180 generates a biasing force that resists the axial movement of mandrel assembly 150 relative to outer housing 130. However, it takes a moment for the biasing force to increase to a degree sufficient to restore shock tool 120 and mandrel assembly 150 to the neutral position. As a result, the pressure pulses generated by pulse generator 110 axially reciprocate piston 190 and mandrel assembly 150 relative to outer housing 130, thereby reciprocally axially extending and contracting shock tool 120. It should be appreciate that as mandrel assembly 150 reciprocates relative to housing 130, the hydraulic oil in chamber 148 moves axially uphole and downhole within chamber 148 between seals 137*a* and seals 196*a*, 196*b*. Anything that impedes the free flow of the hydraulic oil in chamber 148 as it attempts to move with mandrel assembly 150 relative to outer housing 130 during axial extension and contraction of shock tool 120 results in a dampening effect and associated loss of energy. However, embodiments described herein include a combination of features to conserve energy during actuation of shock tool 120 and reduce the energy dissipating effects of tight clearances along hydraulic oil chamber 148. As will be described in more detail below, embodiments described herein reduce and/or eliminate hydraulic oil flow restrictions and thereby enhance the flow of hydraulic oil along each of the following areas of hydraulic oil chamber 148: (1) through annulus 145; (2) between annulus 145 and uphole section 146*a* of annulus 146; (3) around lock ring 167; and (4) between intermeshing splines 134, 166.

Figure 8:
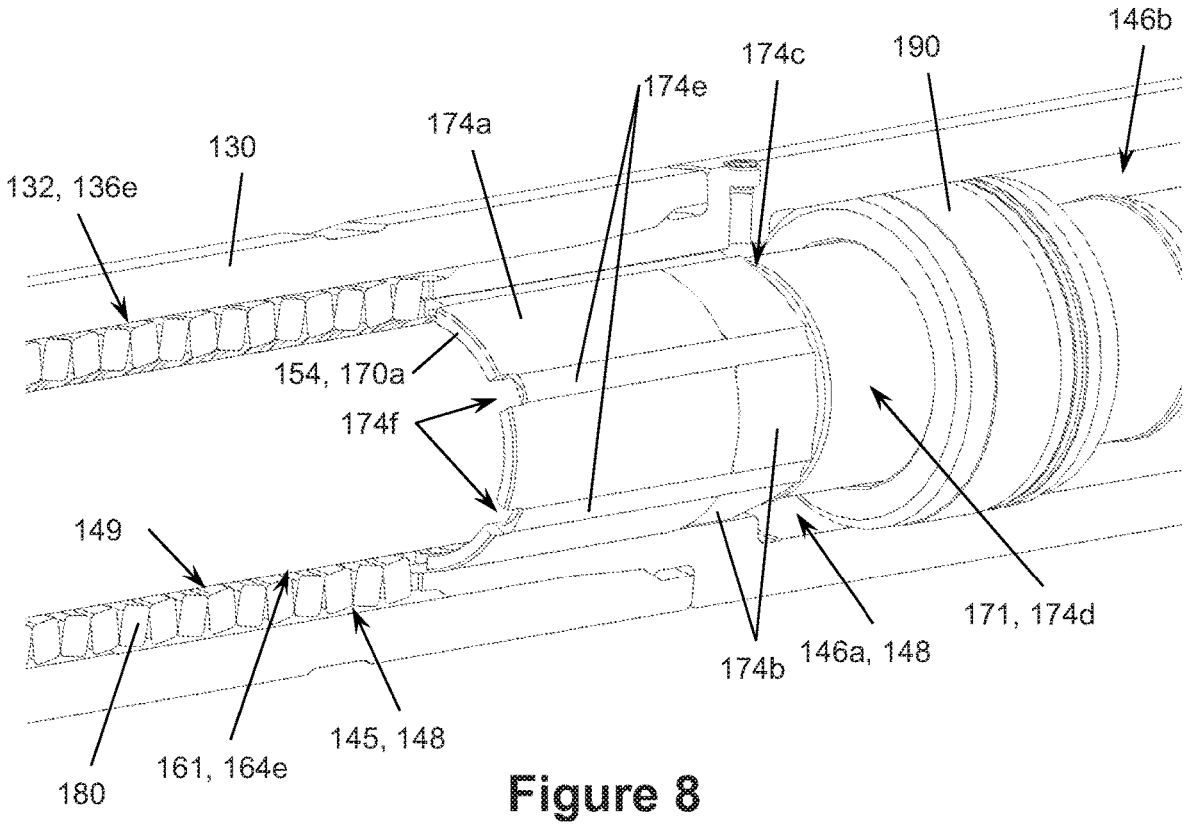
FIG. 8 is a partial cross-sectional perspective view of the shock tool of FIG. 2.
Figure 9:
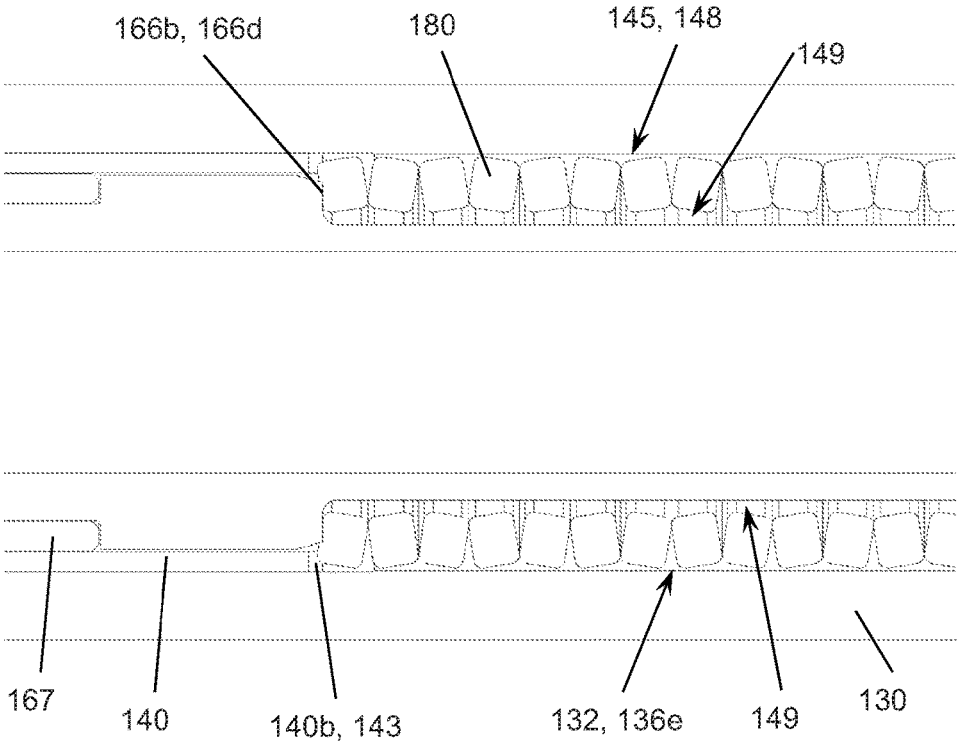
FIG. 9 is a cross-sectional side view of the shock tool of FIG. 2 taken in section 9-9 of FIG. 3.

Referring now to FIGS. 8 and 9, as previously described, biasing member 180 is disposed about mandrel 160 within annulus 145 and comprises a stack of Belleville springs. In this embodiment, the Belleville springs, and hence biasing member 180, are radially spaced from outer surface 161 of mandrel 160 but slidingly engage inner surface 132 of housing 130. In particular, each Belleville spring has an inner diameter greater than the outer diameter of cylindrical surface 164*e* and an outer diameter that is substantially the same as inner diameter of cylindrical surface 136*e* of housing 130. As a result, an annular flow passage or annulus 149 is radially disposed between biasing member 180 and surface 164*e* of mandrel 160. Annulus 149 extends axially from shoulder 166*d* to shoulder 154 defined by end 170*a* of washpipe 170, and thus, provides an unobstructed flow path for hydraulic oil through annulus 145 between shoulders 154, 166*d*. It should be appreciated that sliding engagement of the Belleville springs and cylindrical surface 136*e* of housing 130 centers the Belleville springs and biasing member 180 within annulus 145, thereby maintaining coaxial alignment of the Belleville springs and biasing member 180 with outer housing 130 and mandrel 160.

Many conventional shock tools rely on Belleville springs to bias a mandrel relative to an outer housing within which the mandrel is disposed. Typically, the Belleville springs are disposed about the mandrel in an annulus disposed between the outer housing and the mandrel. In addition, the inner diameter of the Belleville springs slidingly engage the outer surface of the mandrel. As a result, the hydraulic oil in the annulus containing the Belleville springs may be forced to take a tortuous path around the Belleville springs. In contrast, embodiments described herein include annulus 149 radially positioned between outer surface 161 of mandrel 160 and the Belleville springs of biasing member 180. Consequently, hydraulic oil can flow through annulus 145 via annulus 149 without having to follow a tortuous path around the Belleville springs, thereby effectively reducing the resistance to flow of the hydraulic oil in annulus 145 as compared to a conventional shock tool.

Figure 10:
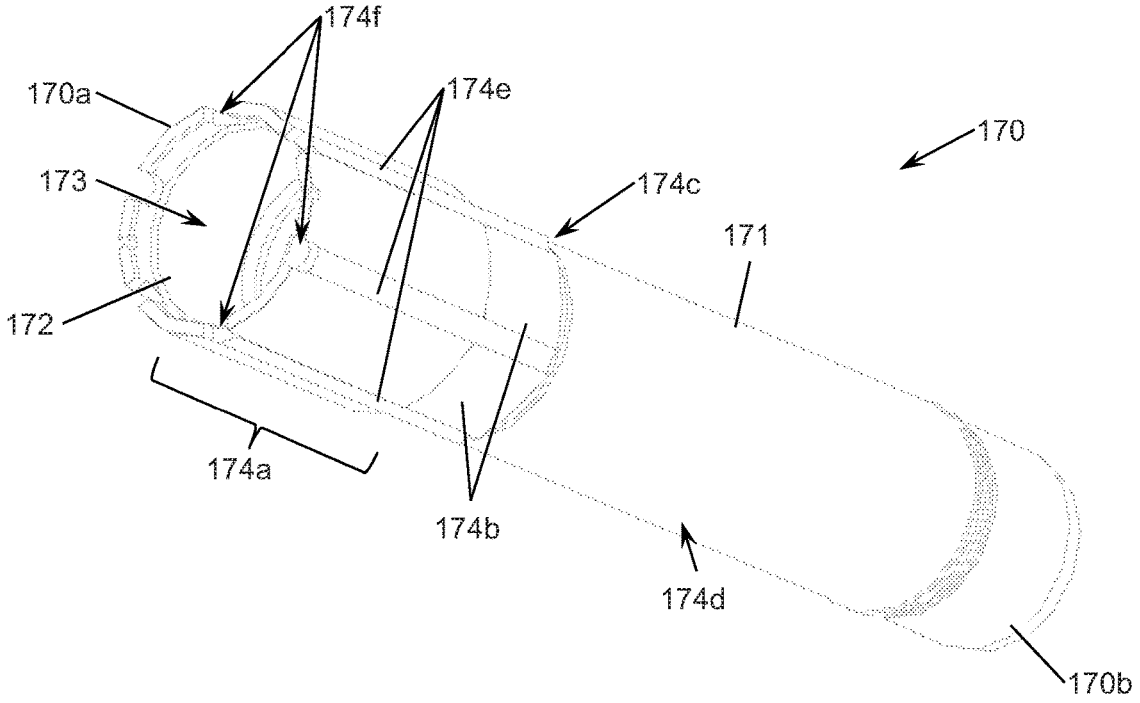
FIG. 10 is a perspective view of the washpipe of FIG. 7.
Figure 11:
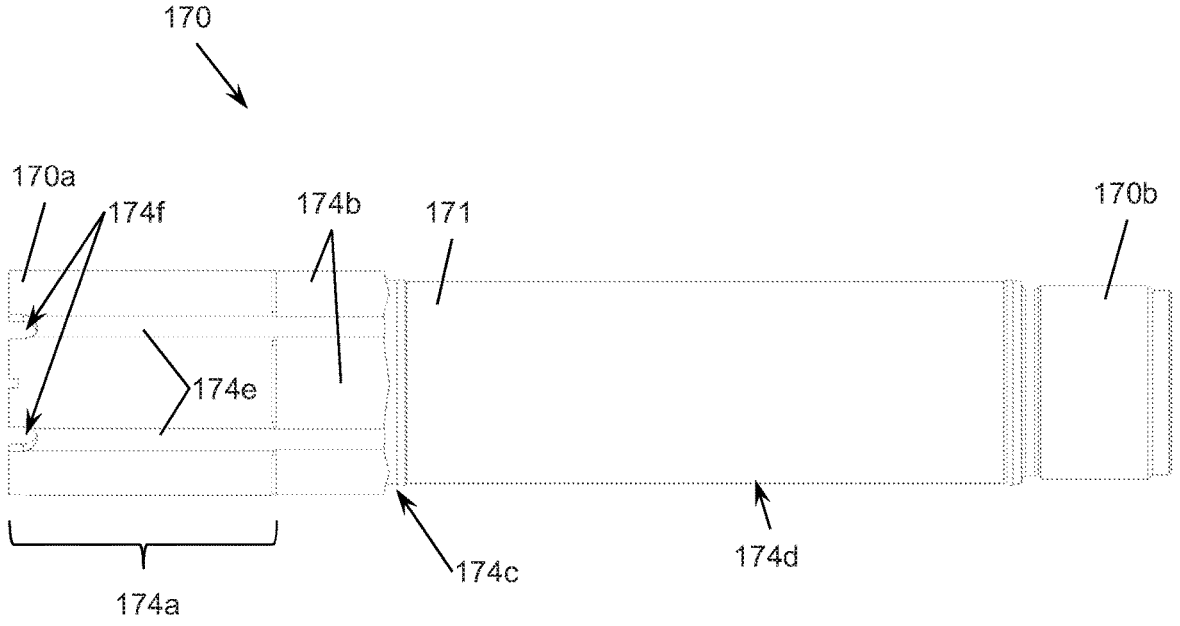
FIG. 11 is a side view of the washpipe of FIG. 7.

Referring now to FIGS. 8, 10, and 11, as previously described, washpipe 170 has ends 170*a*, 170*b* and outer surface 171 extending axially between ends 170*a*, 170*b*. Outer surface 171 includes cylindrical surface 174*a* extending axially from end 170*a*, flats 174*b* axially adjacent cylindrical surface 174*a*, shoulder 174*c* axially adjacent flats 174*b*, and cylindrical surface 174*d* extending axially from shoulder 174*c*. In this embodiment, a plurality of uniformly circumferentially-spaced parallel recesses 174*e* are disposed in cylindrical surface 174*a* and a plurality of uniformly circumferentially-spaced slots 174*f* extending axially from uphole end 170*a*.

Each recess 174*e* extends axially from end 170*a* to shoulder 174*c* and extends radially inward from surface 174*a*. Each flat 174*b* is circumferentially positioned between a pair of circumferentially adjacent recesses 174*e*. In this embodiment, recesses 174*e* have a generally rectangular cross-section.

Slots 174*f* are disposed at end 170*a* and extend radially from outer surface 171 to inner surface 172. Thus, when washpipe 170 is secured to lower end 160*b* of mandrel 160, slots 174*f* extend from outer surface 171 of washpipe 170 to cylindrical surface 164*e* of mandrel 160. Each slot 174*f* is disposed within a corresponding recess 174*e* at end 170*a*. Thus, each slot 174*f* is in direct fluid communication with the corresponding recess 174*e* and annulus 149.

As best shown in FIG. 8 and as previously described, during drilling operations, cylindrical surfaces 136*d*, 174*a* slidingly engage, and end 170*a* of washpipe 170 axially abuts end 180*b* of biasing member 180 when shock tool 120 axially extends. Engagement of surfaces 136*d*, 174*f* and ends 170*a*, 180*b* may restrict the flow of hydraulic oil therebetween. However, in embodiments described herein, recesses 174*e* and slots 174*f* define an alternative, unobstructed flow path for hydraulic oil between uphole section 146*a* of annulus 146 and annulus 149. More specifically, hydraulic oil is free to flow between uphole section 146*a* and recesses 174*e*, and free to flow between recesses 174*e* and annulus 149 via slots 174*f*, thereby bypassing sliding surfaces 136*d*, 174*f* and ends 170*a*, 180*b*.

Figure 12:
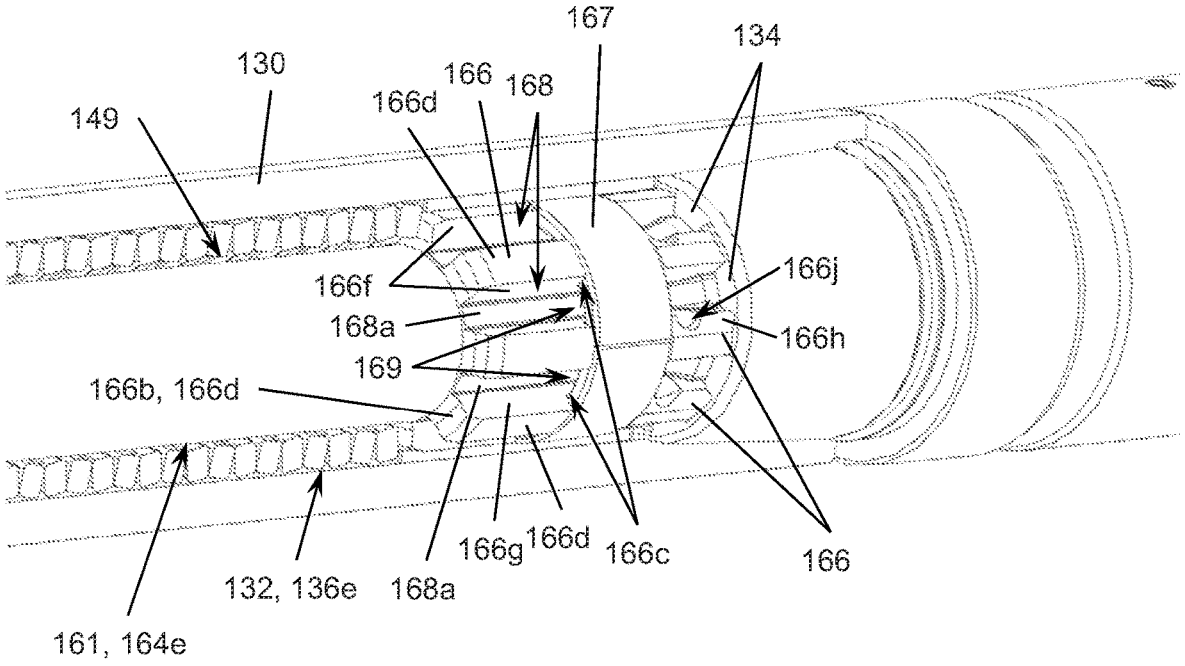
FIG. 12 is a partial cross-sectional perspective view of the shock tool of FIG. 2.
Figure 13:
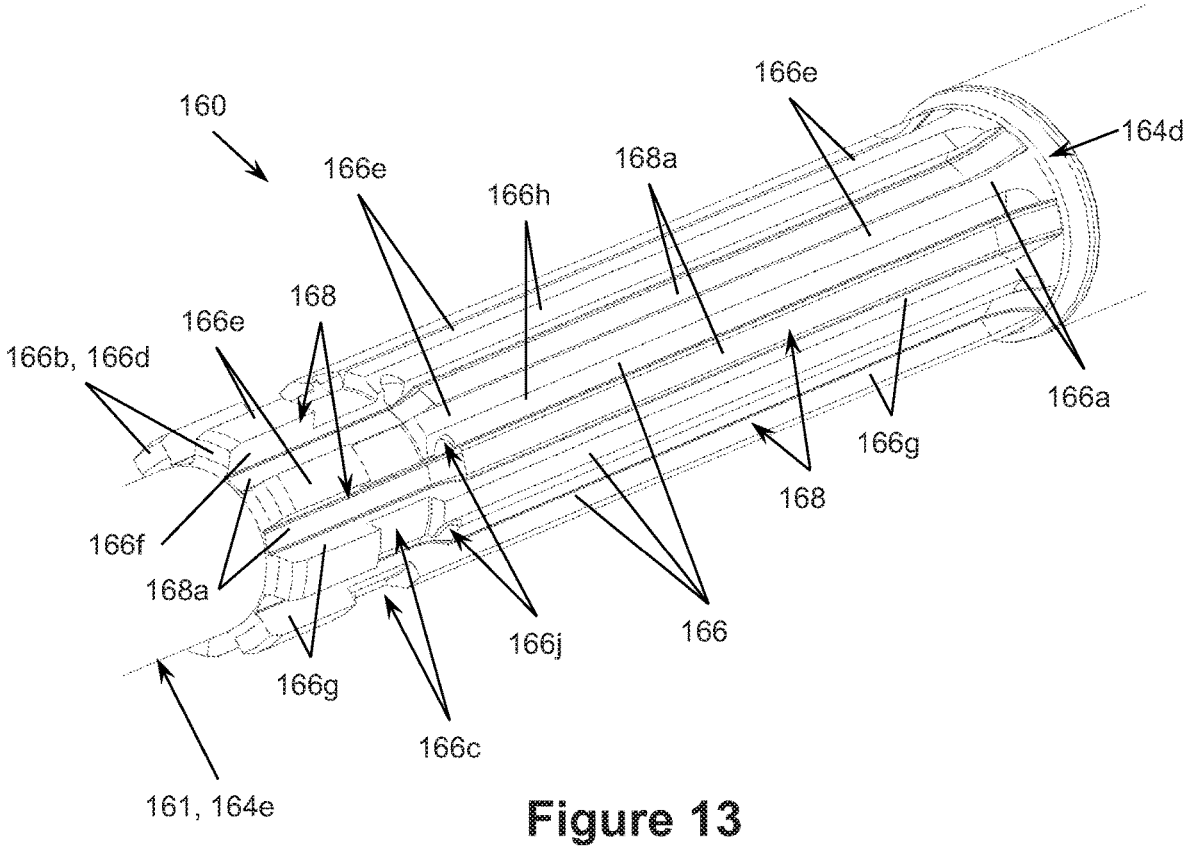
FIG. 13 is an enlarged partial perspective view of the mandrel of FIG. 7.

Referring now to FIGS. 12 and 13, as previously described, outer surface 161 of mandrel 160 includes a plurality of parallel circumferentially-spaced splines 166 that engage and intermesh a plurality of splines 134 on inner surface 132 of outer housing 130. Splines 166 define a plurality of uniformly circumferentially-spaced troughs 168 that receive splines 134. Each trough 168 is circumferentially disposed between a pair of circumferentially adjacent splines 166 and extends axially between ends 166*a*, 166*b*.

Each spline 166 has a radially outer or top surface 166*e* and a pair of parallel lateral side surfaces 166*f*, 166*g*. Each trough 168 is defined by a pair of circumferentially opposed side surfaces 166*f*, 166*g* and a base or bottom surface 168*a* extending circumferentially therebetween. Side surfaces 166*f*, 166*g* extend generally radially outward from corresponding base surfaces 168*a* toward top surface 166*e* of the corresponding spline 166. In this embodiment, top surface 166*e* and lateral sides surfaces 166*f*, 166*g* of each spline 166 are planar surfaces, and bottom surface 168*a* of each trough 168 is generally cylidrncial.

As best shown in FIG. 12, recesses 166*c* are disposed along splines 166 proximal downhole ends 160*b*. Lock ring 167 is seated in recesses 166*c* below lower ends 134*b* of splines 134 to limit the upward travel of mandrel 160 relative to housing 130 (e.g., mandrel 160 can move axially upward relative to housing 130 until lock ring 167 axially engages shoulders 134*d* at lower ends 134*b* of splines 134). Thus, the portions of splines 166 extending axially from lock ring 167 to ends 166*a* engage splines 134 of outer housing 130, while the portions of splines 166 extending axially from lock ring 167 to ends 166*b* do not engage splines 134 of outer housing 130. In other words, splines 134 of outer housing 130 are disposed in the portions of troughs 168 extending axially from lock ring 167 to upper ends 166*a*, while splines 134 of outer housing 130 are not disposed in the portions of troughs extending axially from lock ring to lower ends 166*b*.

In this embodiment, recesses 166*c* extend radially inward from outer surfaces 168*a* of splines 166 but do not extend to bottom surfaces 168*a* between splines 166. As a result, and as best shown in FIG. 12, lock ring 167 is radially spaced from bottom surfaces 168*a* when seated in recesses 166*c*, thereby defining a plurality of circumferentially-spaced ports or flow passages 169 underneath lock ring 167. More specifically, each flow passage 169 is defined by lateral side surfaces 166*f*, 166*g* of circumferentially adjacent splines 166, the bottom surface 168*a* extending between the circumferentially adjacent splines 166, and lock ring 167. As previously described, splines 134 are not disposed in the portions of troughs 168 disposed below lock ring 167. In addition, the lower ends of troughs 168 adjacent ends 166*b* of splines 166 are in direct fluid communication with annulus 149. Accordingly, the portions of troughs 168 extending from lower ends 166*b* of splines 166 to lock ring 167 and passages 169 provide an unobstructed flow path for hydraulic oil to flow between annulus 149 and the portions of troughs 168 extending axially upward from lock ring 167, thereby enhancing the free flow of hydraulic oil between annulus 149 and splines 134, 166.

Figure 14:
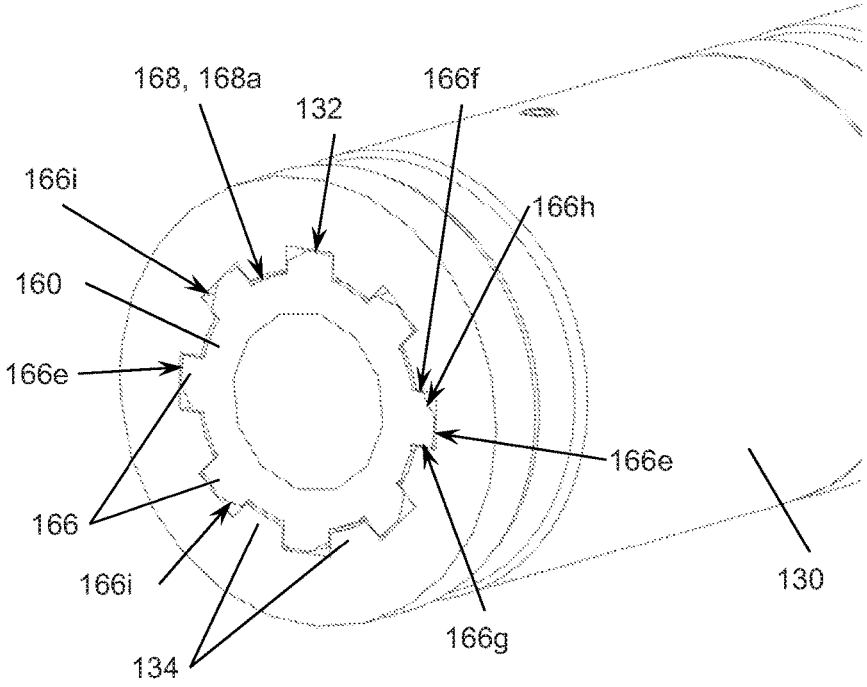
FIG. 14 is a cross-sectional perspective view of the shock tool of FIG. 2 illustrating the intermeshing splines of the mandrel and the outer housing.

Referring now to FIGS. 12-14, as previously described, splines 134 of outer housing 130 are slidably disposed in the portions of troughs 168 extending axially from lock ring 167 to uphole ends 166*a*. On the portions of splines 166 extending axially from lock ring 167 to downhole ends 166*b*, lateral side surfaces 166*g*, 166*f* extend radially from the corresponding top surface 166*e* to the circumferentially adjacent bottom surfaces 168*a*, and thus, have generally rectangular cross-sectional shapes. However, sliding engagement of generally rectangular splines 134 with the portions of 166 extending from lock ring 167 to uphole ends 166*a* may restrict the flow of hydraulic oil along the portion of chamber 148 extending axially between passages 149 and shoulder 164*d*. Thus, in embodiments described herein, the portions of splines 166 extending from recesses 166*c* to uphole ends 166*a* have different geometries than the portions of splines 166 extending axially from lock ring 167 to downhole ends 166*b* to enhance the flow of hydraulic oil between splines 134, 166 along the portion of chamber 148 extending axially between passages 149 and shoulder 164*d*. In particular, the portion of each spline 166 extending from the corresponding recess 166*c* to uphole end 166*a* includes top surface 166*e* and lateral side surfaces 166*f*, 166*g*. Lateral side surface 166*g* extends radially from a corresponding base surface 168*a* to the corresponding top surface 168*e*, however, lateral side surface 166*f* does not extend radially from the corresponding base surface 168*a* to the corresponding top surface 168*e*. Rather, in this embodiment, the portion of each spline 166 extending from lock ring 167 to uphole end 166*a* includes an additional surface 166*h* disposed between top surface 168*e* to lateral side surface 166*f*. In this embodiment, surfaces 166*h* is a planar surface extending from top surface 168*e* to lateral side surface 166*f*, and extending axially from lock ring 167 to uphole end 166*a*. As a result, the portion of each spline 166 extending from lock ring 167 to uphole end 166*a* has a generally trapezoidal cross-sectional geometry. It should be appreciated that the trapezoidal cross-sectional geometry of the portion of each spline 166 extending from lock ring 167 to uphole end 166*a* is different than the generally rectangular cross-sectional geometry of the portion of each spline extending from lock ring 167 to downhole end 166*b*.

As best shown in FIG. 14, surface 166*h* is disposed at an acute angle relative to the corresponding lateral side surface 166*f* and top surface 166*e*, and thus, may also be referred to as a bevel or beveled surface. In this embodiment, each surface 166*h* is oriented at an acute angle between 20° and 60° relative to the corresponding top surface 166*e*. In addition, in this embodiment, each surface 166*h* intersects the corresponding lateral side surface 166*f* proximal the mid-point of the vertical height of the corresponding spline 166 (as measured radially from base surface 168*a* of one of the adjacent troughs to top surface 166*f*).

With splines 134 of outer housing 130 disposed in troughs 168, an unobstructed flow passage 166*i* is disposed between inner surface 132 of outer housing 130 and the portion of each spline 166 extending from lock ring 167 to uphole end 166*a*. Each passage 166*i* has a triangular cross-sectional shape defined by surface 166*h* and inner surface 132 between splines 134. Each passage 166*i* extends axially from lock ring 167 to uphole end 166*a*.

During drilling operations, intermeshing splines 134, 166 transfer rotational torque between mandrel assembly 150 and outer housing 130. In particular, rotation of drillstring 22 rotates mandrel assembly 150, which in turn rotates outer housing 130 as splines 166 of mandrel 160 bear against splines 134 of outer housing 140 to transfer rotational torque from mandrel 160 to outer housing 130. To maximize the strength and contact surface area of the surface of splines 134, 166 that contact to transfer torque, each surface 166*h* and each passage 166*i* is positioned circumferentially opposite the lateral side surface 166*f*, 166*g* that bears against a corresponding spline 134 to transfer torque. In this embodiment, each lateral side surface 166*g* bears against a corresponding spline 134 to transfer torque from mandrel 160 to outer housing 130, and thus, each surface 166*h* and each passage 166*i* is disposed along the opposite lateral side surface 166*f*.

Referring still to FIGS. 12-14, each spline 166 also includes a pocket 166*j* axially adjacent lock ring 167. Each pocket 166*j* is disposed along lateral side surface 166f and extends radially from a corresponding bottom surface 168*a* to surface 166*h*. Pockets 166*j* provide fluid communication between passages 169, 166*i*, thereby allowing the unobstructed flow of hydraulic oil between splines 134, 166 along the portion of chamber 148 extending axially between passages 149 and shoulder 164*d*.

In the manner described, shock tool 120 includes a plurality of features arranged and configured to reduce and/or eliminate restrictions on the flow of hydraulic oil through chamber 148 during reciprocal axial extension and contraction of shock tool. In particular, recesses 174*e* and slots 174*f* provide unobstructed fluid communication between uphole section 146*a* of annulus 146 and annuli 145, 149; annulus 149 provides unobstructed fluid communication between slots 174*f* and troughs 168; troughs 168 and passages 169 provide unobstructed fluid communication between annulus 149 and pockets 166*j*; and passages 166*i* provide unobstructed fluid communication between pockets 166*j* and shoulder 164*d*. Individually, and collectively, these features reduce dampening and associated loss of energy during actuation of shock tool 120, thereby offering the potential to enhance or optimize the transfer of energy from pressure pulses generated by pulse generator 110 to mandrel assembly 150.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A shock tool for reciprocating a drillstring, the shock tool comprising:

an outer housing having a central axis, a first end, a second end opposite the first end, and a radially inner surface defining a passage extending axially from the first end to the second end, wherein the radially inner surface of the outer housing includes a plurality of circumferentially-spaced splines;

a mandrel assembly coaxially disposed in the passage of the outer housing and configured to move axially relative to the outer housing, wherein the mandrel assembly has a first end axially spaced from the outer housing, a second end disposed in the outer housing, and a passage extending axially from the first end of the mandrel assembly to the second end of the mandrel assembly, wherein the mandrel assembly includes a mandrel having a radially outer surface including a plurality of circumferentially-spaced splines and a plurality of circumferentially-spaced troughs, wherein each trough is circumferentially disposed between a pair of circumferentially adjacent splines of the plurality of splines, wherein each spline of the outer housing is disposed in one trough of the mandrel;

wherein each spline of the mandrel includes a radially outer top surface, a first lateral side surface extending from the top surface to a bottom surface of a circumferentially adjacent trough, a second lateral side surface extending radially from a circumferentially adjacent trough, and a bevel extending from the top surface to the second lateral side surface;

wherein each spline of the mandrel also includes a pocket in the second lateral side surface extending radially from the corresponding bottom surface to the bevel.

2. The shock tool of claim 1, wherein each bevel is oriented at an acute angle relative to the corresponding top surface and the corresponding second lateral side surface.

3. The shock tool of claim 1, further comprising a first flow passage positioned between each spline of the mandrel and the outer housing, wherein each of the first flow passages is defined by the radially inner surface of the outer housing and one of the bevels.

4. The shock tool of claim 1, further comprising a lock ring disposed about the plurality of splines of the mandrel and configured to limit the axial movement of the mandrel assembly relative to the outer housing;

wherein each spline of the mandrel has an first end, a second end, and a recess axially positioned between the first end and the second end of the spline, wherein each recess extends radially inward from the top surface of the corresponding spline of the mandrel, and wherein the lock ring is seated in the recess of each spline;

wherein each pocket is axially adjacent the recess of the corresponding spline and is axially positioned between the recess of the corresponding spline and the first end of the corresponding spline.

5. The shock tool of claim 4, further comprising a passage radially positioned between the lock ring and the radially outer surface of the mandrel.

6. The shock tool of claim 1, further comprising a biasing member disposed about the mandrel, wherein the biasing member is disposed in a first annulus radially positioned between the mandrel assembly and the outer housing, wherein the biasing member is configured to generate an axial biasing force that resists axial movement of the mandrel assembly relative to the outer housing;

wherein the first annulus is axially adjacent the plurality of splines of the mandrel;

an annular flow path radially positioned between the biasing member and the mandrel, wherein the annular flow path extends axially from a first end of the biasing member to a second end of the biasing member.

7. The shock tool of claim 6, further comprising an annular floating piston moveably disposed about a washpipe of the mandrel assembly, wherein the annular floating piston is disposed in a second annulus radially positioned between the mandrel assembly and the outer housing, and wherein the annular floating piston is configured to move axially relative to the mandrel assembly and the outer housing;

wherein the washpipe has an first end fixably coupled to the mandrel and a second end distal the mandrel;

wherein the washpipe has a radially outer surface extending axially from the first end of the washpipe to the second end of the washpipe;

wherein the radially outer surface of the washpipe includes a first cylindrical surface extending axially from the first end of the washpipe and a second cylindrical surface axially positioned between the first cylindrical surface of the washpipe and the second end of the washpipe, wherein the annular floating piston slidably engages the second cylindrical surface;

wherein the first cylindrical surface of the washpipe slidingly engages the radially inner surface of the outer housing;

wherein the outer surface of the washpipe includes a plurality of circumferentially-spaced recesses in the first cylindrical surface, wherein each recess extends from the first end of the washpipe.

8. The shock tool of claim 7, wherein the washpipe includes a plurality of circumferentially-spaced slots extending axially from the first end of the washpipe, wherein each slot extends radially from the radially outer surface of the washpipe to a radially inner surface of the washpipe, and wherein each slot is disposed in one of the recesses.

9. The shock tool of claim 7, wherein the second annulus is axially positioned between the first annulus and the second end of the mandrel assembly.

10. The shock tool of claim 7, further comprising:

an annular seal assembly radially positioned between the outer housing and the mandrel assembly proximal the first end of the outer housing;

a hydraulic oil chamber radially positioned between the mandrel assembly and the outer housing, wherein the hydraulic oil chamber extends axially from the annular seal assembly to the annular floating piston.

11. A shock tool for reciprocating a drillstring, the shock tool comprising:

an outer housing having a central axis, an upper end, a lower end, and a passage extending axially from the upper end to the lower end;

a mandrel assembly disposed in the passage of the outer housing and extending telescopically from the upper end of the outer housing, wherein the mandrel assembly is configured to move axially relative to the outer housing to axially extend and contract the shock tool;

a biasing member disposed about the mandrel assembly in a first annulus radially positioned between the mandrel assembly and the outer housing, wherein the biasing member is configured to generate an axial biasing force that resists axial movement of the mandrel assembly relative to the outer housing, and wherein the biasing member slidably engages the outer housing and is radially spaced from the mandrel assembly; and an annular flow passage radially positioned between the biasing member and the mandrel assembly, wherein the annular flow passage extends axially from an upper end of the biasing member to a lower end of the biasing member.

12. The shock tool of claim 11, wherein the biasing member comprises a stack of Belleville springs, wherein the stack of Belleville springs has an inner diameter greater than an outer diameter of a portion of the mandrel assembly about which the biasing member is disposed and an outer diameter that is substantially the same as an inner diameter of a portion of the outer housing within which the biasing member is disposed.

13. The shock tool of claim 11, further comprising an annular floating piston moveably disposed about the mandrel assembly, wherein the annular floating piston is disposed in a second annulus radially positioned between the mandrel assembly and the outer housing, and wherein the annular floating piston is configured to move axially relative to the mandrel assembly and the outer housing.

14. The shock tool of claim 13, wherein the mandrel assembly comprises a mandrel and a washpipe;

wherein the washpipe has an upper end fixably coupled to the mandrel, a lower end distal the mandrel, a radially outer surface extending axially from the upper end of the washpipe to the lower end of the washpipe, and a radially inner surface extending axially from the upper end of the washpipe to the lower end of the washpipe;

wherein the radially outer surface of the washpipe includes a first cylindrical surface extending axially from the upper end of the washpipe and a second cylindrical surface axially positioned between the first cylindrical surface of the washpipe and the lower end of the washpipe, wherein the annular floating piston slidably engages the second cylindrical surface;

wherein the outer surface of the washpipe includes a plurality of circumferentially-spaced recesses in the first cylindrical surface, wherein each recess extends from the first end of the washpipe.

15. The shock tool of claim 14, wherein the washpipe includes a plurality of circumferentially-spaced slots extending axially from the upper end of the washpipe, wherein each slot extends radially from the radially outer surface of the washpipe to a radially inner surface of the washpipe, and wherein each slot is disposed in one of the recesses;

wherein the annular flow path is in direct fluid communication with the slots of the washpipe.

16. The shock tool of claim 14, further comprising:

an annular seal assembly radially positioned between the outer housing and the mandrel assembly proximal the upper end of the outer housing;

a hydraulic oil chamber radially positioned between the mandrel assembly and the outer housing, wherein the hydraulic oil chamber extends axially from the annular seal assembly to the annular floating piston.

17. The shock tool of claim 16, further comprising:

a catch coupled to the lower end of the washpipe and defining the lower end of the mandrel assembly;

a third annulus radially positioned between the catch and the outer housing;

wherein the annular floating piston divides the second annulus into an upper section extending axially from the annular floating piston toward the upper end of the washpipe and a lower section extending axially from the annular floating piston toward the lower end of the mandrel assembly;

wherein the third annulus and the lower section of the second annulus are in fluid communication.

18. The shock tool of claim 11, wherein a radially inner surface of the outer housing includes a plurality of circumferentially-spaced splines;

wherein a radially outer surface of the mandrel assembly includes a plurality of circumferentially-spaced splines and a plurality of circumferentially-spaced troughs, wherein one trough is circumferentially disposed between each pair of circumferentially adjacent splines of the mandrel assembly, wherein each spline of the outer housing is disposed in one trough of the mandrel assembly;

wherein each spline of the mandrel assembly has an upper end, a lower end, a recess axially positioned between the upper end and the lower end, an upper portion extending axially from the recess to the upper end, and a lower portion extending axially from the recess to the lower end, wherein the upper portion of each spline of the mandrel assembly has a cross-sectional geometry that is different from a cross-sectional geometry of the lower portion of the spline.

19. The shock tool of claim 18, wherein the cross-sectional geometry of the upper portion of each spline is trapezoidal and the cross-sectional geometry of the lower portion of each spline is rectangular.

20. The shock tool of claim 18, wherein the upper portion of each spline of the mandrel assembly includes a pocket extending radially outward along a lateral side of the spline to a flow passage extending axially between the spline of the mandrel and the radially inner surface of the outer housing.

* * * * *